US006468190B1

(12) United States Patent
Fazio et al.

(10) Patent No.: US 6,468,190 B1
(45) Date of Patent: Oct. 22, 2002

(54) CHEST AND BODY EXERCISER

(75) Inventors: Renee S. Fazio, Seminole, FL (US); Genevieve M. Griffin, 9091 Baywood Park Dr., Seminole, FL (US) 34647

(73) Assignee: Genevieve M. Griffin, Orlando, FL (US)

( * ) Notice: Subject to any disclaimer, the term of this patent is extended or adjusted under 35 U.S.C. 154(b) by 0 days.

(21) Appl. No.: 09/006,692

(22) Filed: Jan. 13, 1998

Related U.S. Application Data

(62) Division of application No. 08/646,493, filed on May 8, 1996, now Pat. No. 5,735,780.

(51) Int. Cl.[7] ..... A63B 21/008
(52) U.S. Cl. ..... 482/112; 482/111; 482/114
(58) Field of Search ..... 482/111, 112, 482/114, 128, 91, 113, 51, 92, 53, 58, 73; 188/151 R, 361–363, 266, 269

(56) References Cited

U.S. PATENT DOCUMENTS

| | | | | | |
|---|---|---|---|---|---|
| 767,008 | A | * | 8/1904 | Pelletier | 482/112 |
| 3,174,343 | A | * | 3/1965 | Kasulis | 482/112 |
| 3,471,145 | A | * | 10/1969 | Berger | 482/112 |
| 3,834,696 | A | * | 9/1974 | Spector | 482/112 |
| 3,836,141 | A | * | 9/1974 | Franklyn | 272/79 |
| 3,884,463 | A | * | 5/1975 | Malatesta | 482/112 |
| 4,148,479 | A | * | 4/1979 | Spector | 482/112 |
| 4,290,599 | A | * | 9/1981 | Berger | 482/112 |
| 4,291,787 | A | * | 9/1981 | Brentham | 188/318 |
| 4,333,645 | A | * | 6/1982 | Wu | 482/112 |
| 4,635,931 | A | * | 1/1987 | Brannstam | 482/112 |
| 4,772,016 | A | * | 9/1988 | Manion | 482/112 |
| 4,842,273 | A | * | 6/1989 | Schmeiss | 272/141 |
| 4,865,317 | A | * | 9/1989 | Hickey | 272/141 |
| 4,951,941 | A | * | 8/1990 | Resk | 272/130 |
| 4,981,199 | A | * | 1/1991 | Tsai | 482/112 X |
| 5,250,015 | A | * | 10/1993 | Thornton | 482/112 |
| 5,443,370 | A | * | 8/1995 | Wang | 417/238 |
| 5,529,559 | A | * | 6/1996 | Punzalan | 482/112 |
| 5,803,879 | A | * | 9/1998 | Huang | 482/112 |

* cited by examiner

*Primary Examiner*—Michael A. Brown
*Assistant Examiner*—Lori Baker Amerson
(74) *Attorney, Agent, or Firm*—Edward M. Livingston, Esq.

(57) ABSTRACT

A chest exerciser has a pneumatic resister (1) of linear motion and a selection of handle (8, 9), attachment (29) and/or anchor means (34, 40, 42) that are positional on opposite ends for direction of selectively push exercise and pull exercise to select muscle groups and to specific muscles in the select muscle groups. The pneumatic resister of linear motion can be a cylindrical pump (6, 7), an accordion bellows pump (4), a variously telescopic bellows pump (5), a resilient pump or other pneumatic pump or combinations of pneumatic pumps. The pneumatic resister of linear motion can be selectively resistant to linear motion by means of flow resisters (2, 3) that can be adjustable of resistance or rate of inflow and outflow of air. Separate inflow and outflow resisters (2, 3) can be provided for adjustment of push and pull exercise. Handle means can be different for different sizes of hands and for different positioning of the pneumatic resister in relation to muscles. Attachment and anchor means can be provided for positioning the pneumatic resister in desired relationship to select muscle groups and to specific muscles in muscle groups of a body. Pneumatic resister exercise devices having two or more cylinders **(106, 107, 121*a*,121*b*, 121*c*, 121*d*) are also provided with one or more handles which are movable. The resistance of the exercise device may also be supplemented by springs (119*a*, 119*b*, 120*a*, 120*b*)** to provide additional resistance for inward and outward movement.

10 Claims, 8 Drawing Sheets

FIG. 5
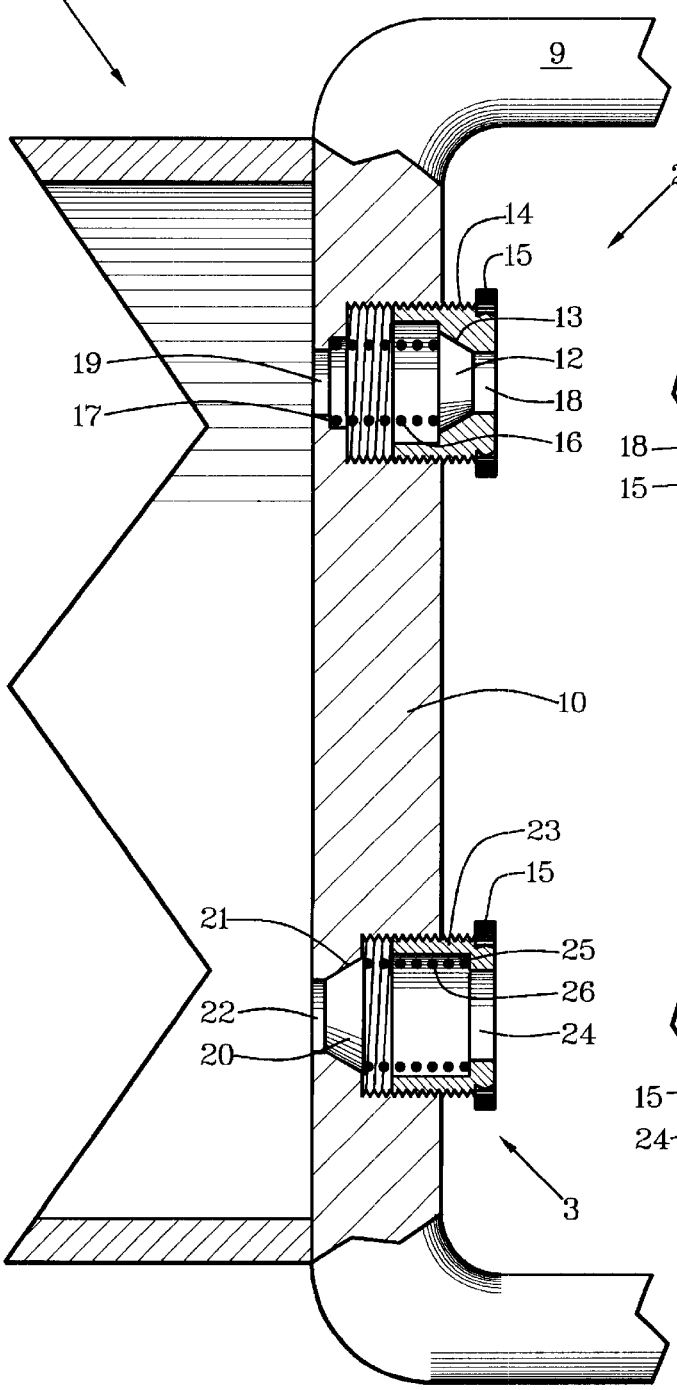
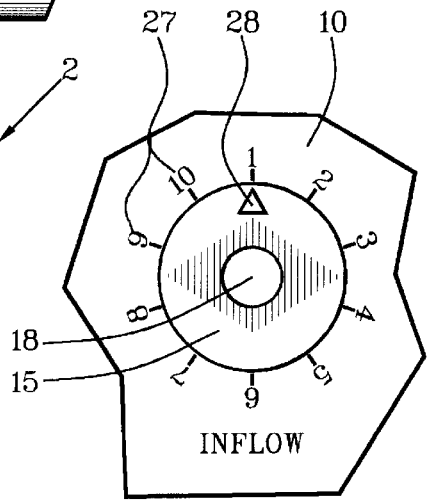
FIG. 6
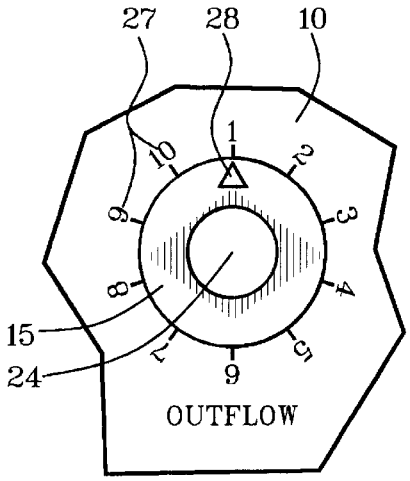
FIG. 7

FIG. 8
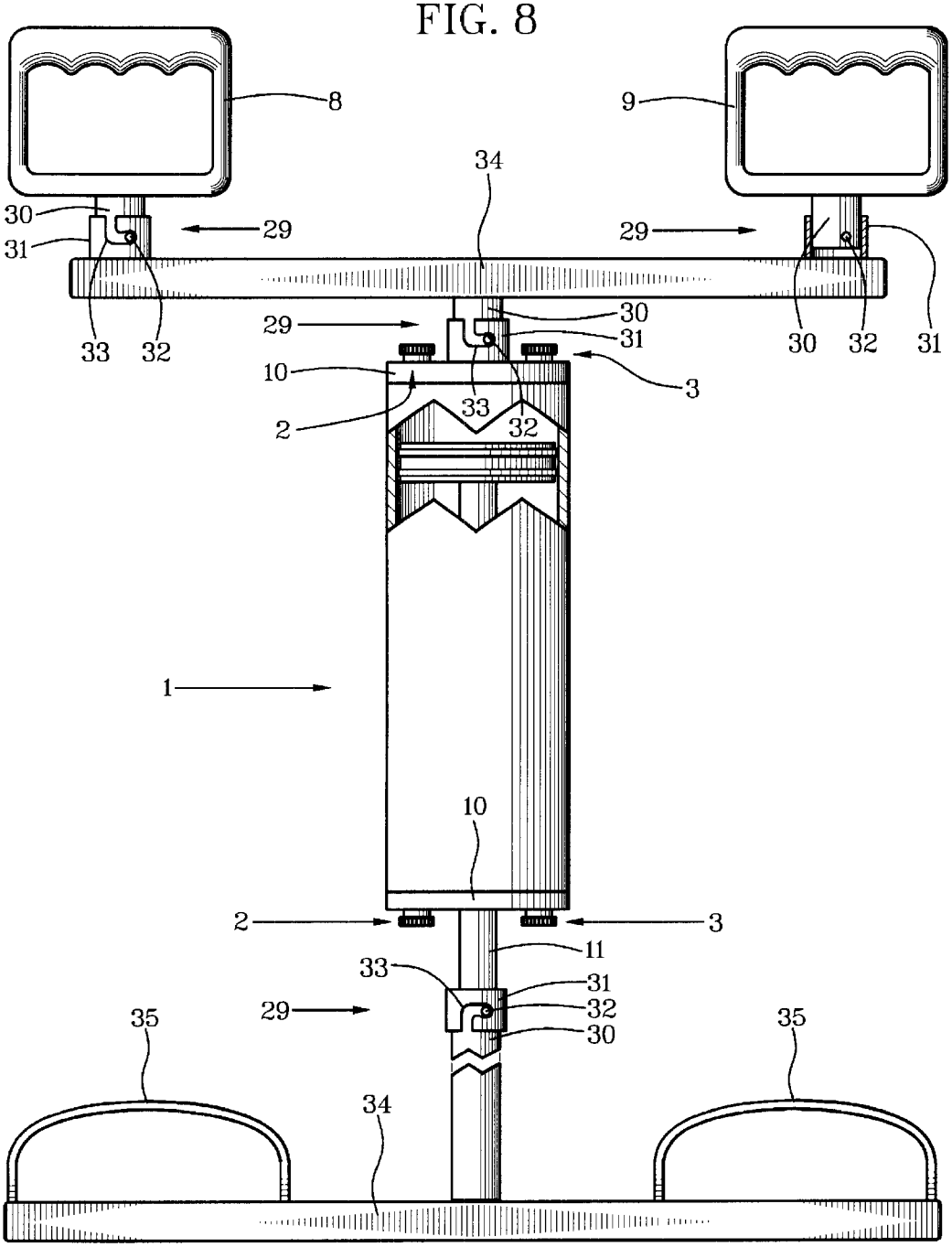
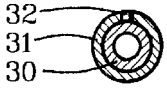
FIG. 9

CHEST AND BODY EXERCISER

This application is a division of Ser. No. 08/646,493 filed May 8, 1996 now U.S. Pat. No. 5,735,780.

BACKGROUND OF THE INVENTION

This invention relates to exercising devices and in particular to a pneumatic resister of linear motion having a selection of handle, attachment and/or anchor means that are positional on opposite ends for direction of selectively push exercise and pull exercise to select muscle groups and to specific muscles in the select muscle groups.

A wide variety of motion resisters have been devised for expending exercise work to build muscles. None are known, however, to be pneumatic motion resisters having equally or selectively variable opposite-directional motion resistance with select handle, attachment and/or anchor means positional on opposite ends in a manner taught by this invention.

Examples of spring exercise devices that are related but different are described in the following patent documents: U.S. Pat. No. 5,267,929, issued to Chen on Dec. 7, 1993; U.S. Pat. No. 5,246,413, issued to Koblick on Sep. 21, 1993; U.S. Pat. No. 5,026,050, issued to Leung, et al. on Jun. 25, 1991; U.S. Pat. No. 4,483,533, issued to Mangiapane on Nov. 20, 1984; U.S. Pat. No. 3,497,216, issued to Feather on Feb. 24, 1970; and U.S. Pat. No. 2,806,699, issued to Spooner on Sep. 17, 1957. Unfortunately, spring-resister type exercise devices are not as safe as pneumatic-resister type exercise devices as skin can get caught between spring coils and the spring device can open quickly and hurt the user.

An example of a different but related pneumatic motion resister is described in U.S. Pat. No. 5,044,630, issued to Ventimiglia on Sep. 3, 1991. The Ventimiglia device, however, was limited to use of elbow pads that specifically direct exercise work to arms instead of to chest and shoulder areas as taught by this invention. Further, the Ventimiglia device was not adaptable to select positioning of handle, attachment and/or anchor means as taught by this invention.

A great need exists for a chest exerciser with which exercise work can be directed precisely to chest muscles. This is important for both women and men. For women, it is because chest muscles make healthy breasts which aid bodily health and do not sag. Instead, muscle at tops and sides of breasts are developed to hold them up, to protect them and to facilitate mammary circulation. Cosmetically, the muscles at tops of breasts cause higher and larger bust configuration. The muscles at sides of breasts add cleavage beauty and breast width that are very attractive. Overall, the breasts can be enlarged with a highly beneficial and safe health effect instead of with breast implants. It also obviates the need for humiliating breast-extension cups.

For men, it is important for some of the same reasons as for women but with different body-structure effects. Development of chest muscles aids circulation in the chest area and looks good. Area-specific exercise of chest muscles causes huge male chest buildup that conveys attractive masculinity in a manner in which similar female chest buildup on breasts conveys attractive femininity.

Improved chest circulation for both women and men also aids circulation in arms and hands. Highly important also, it aids vascular circulation for the heart, the head and the nerves of both sexes.

There is an urgently vast need also for area-specificness of a low-weight, small and inexpensive motion resister to be adaptable and adjustable selectively to exercise of other parts of bodies.

Further yet, there is need for motion resistance with area-specificness to be adjustable separately for opposite directions of linear motion resistance. Resistance of both push and pull provides weight-lifting effects in opposite directions. Some muscle groups and some specific muscles in different muscle groups are best exercised with push and others with pull exertion. Particularly chest group muscles of both females and males have some specific muscles that are best exercised with push and others with pull. Arm and leg muscles are similar in relation to different specific muscles. It is direction of appropriate push and pull exertion to specific muscles in muscle groups that gives the special effects of desired muscle protrusion.

Thus a chest exerciser is adaptable to exercise other muscle groups with precise muscle-area specificity that is effective and efficient for chest buildup of both females and males. One of its utilities is its adaptability of appropriate exertion exercise to different muscle groups and to specific muscles in muscle groups throughout a body as well as to the chest area.

SUMMARY OF THE INVENTION

In light of need for improved exercise devices and methods, objects of this invention are to provide a chest exerciser which:

Is a pneumatic resister of linear motion;

Provides selectively push exercise and pull exercise;

Provides selective levels of push and pull resistance;

Is low-weight, small and inexpensive;

Has selective handle means that are positional on opposite ends for different individual characteristics and for application to different muscles of the chest area; and Has selective attachment and/or anchor means that are positional on opposite ends for different individual characteristics and for application to select muscle groups and to specific muscles of the select muscle groups in a body.

This invention accomplishes these and other objectives with a chest exerciser having a pneumatic resister of linear motion and a selection of handle, attachment and/or anchor means that are positional on opposite ends for direction of selectively push exercise and pull exercise to select muscle groups and to specific muscles in the select muscle groups. The pneumatic resister of linear motion can be a cylindrical pump, a bellows pump, a variously telescopic pump, a resilient pump or other pneumatic pump or combinations of pneumatic pumps. The pneumatic resister of linear motion can be selectively resistant to linear motion by means of flow resisters that can be adjustable of resistance or rate of inflow and outflow of air. Separate inflow and outflow resisters can be provided for adjustment of push and pull exercise. Handle means can be different for different sizes of hands and for different positioning of the pneumatic resister in relation to muscles. Attachment and anchor means can be provided for positioning the pneumatic resister in desired relationship to select muscle groups and to specific muscles in muscle groups of a body.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

FIG. 5 is an exploded fragmentary sectional view of an inflow resister and an outflow resister in relation to an internal periphery of a pneumatic resister of linear motion;

FIG. 6 is a fragmentary top view of an inflow resistor;

FIG. 7 is a fragmentary top view of an outflow resister;

FIG. 8 is a partially cutaway elevation view of a pneumatic resister of linear motion with quick-disconnect attachments for handles and other exercise components;

FIG. 9 is a top view of an alternative quick-disconnect attachment;

DESCRIPTION OF PREFERRED EMBODIMENT

Figure 1:
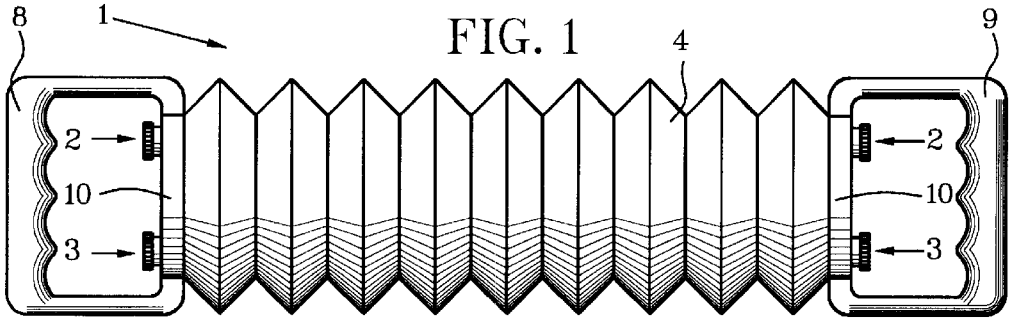
FIG. 1 is a side view of an embodiment with an accordion pneumatic resister of linear motion.
Figure 2:
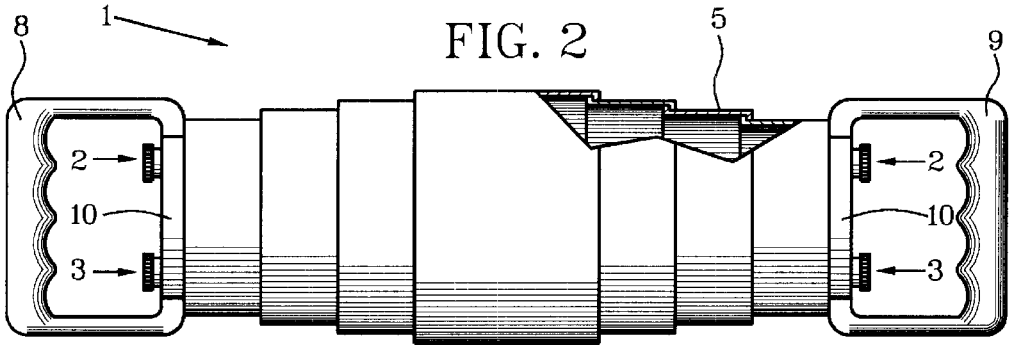
FIG. 2 is a partially cutaway side view of an embodiment with a telescopic pneumatic resister of linear motion.
Figure 3:
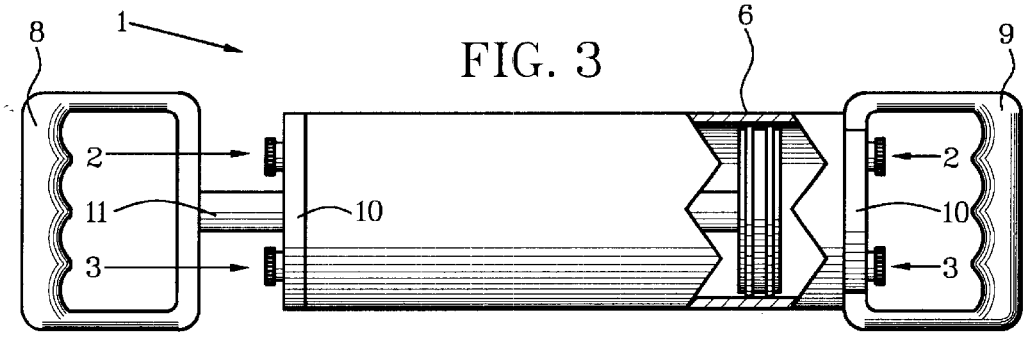
FIG. 3 is a partially cutaway side view of an embodiment with a single-plunger-pump pneumatic resister of linear motion.
Figure 4:
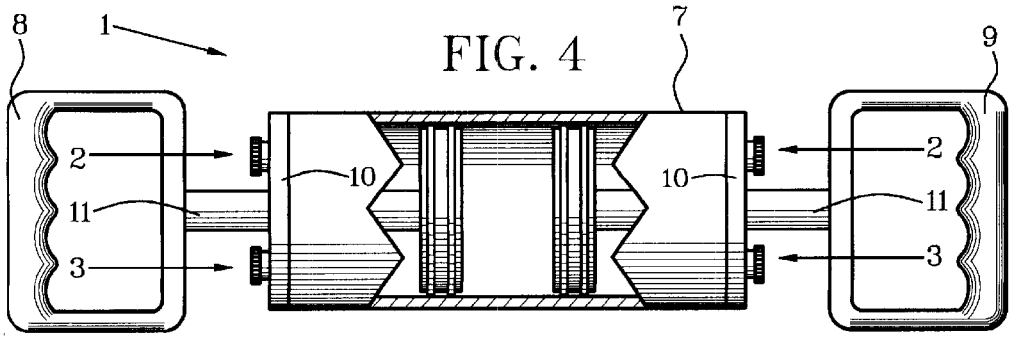
FIG. 4 is a partially cutaway side view of an embodiment with a double-plunger-pump pneumatic resister of linear motion.

Reference is made first to FIGS. 1–4. A pneumatic resister 1 of linear motion is a select type of pneumatic pressurizer that is operated linearly with pneumatic resistance of airflow through a design form of flow regulator with at least one inflow resister 2 and/or at least one outflow resister 3. Examples of select pneumatic resisters 1 are an accordion pneumatic resister 4 shown in FIG. 1, a telescopic pneumatic resister 5 shown in FIG. 2, a single-plunger pneumatic resister 6 shown in FIG. 3, and a double-plunger pneumatic resister 7 shown in FIG. 4. In a preferred embodiment as a chest exerciser, all pneumatic resisters 1 depicted in FIGS. 1–4 have a first handle 8 and a second handle 9 that are attached to end plates 10 and to plunger shafts 11, respectively, for separate types of pneumatic resisters 1 as illustrated. End plates 10 are preferred design walls of different types of pneumatic resisters for positioning of inflow resisters 2 and outflow resisters 3.

Referring to FIGS. 5–7, a selection of flow-resistant means such as inflow resister 2 and outflow resister 3 are foreseeable. An inflow resister 2 can be a type that has an inlet valve 12 which seats against an inlet-valve seat 13 in a threaded inlet-adjustment sleeve 14 having an adjustment knob 15 that is preferably knurled. An inlet-valve spring 16 can be anchored in an inlet-orifice step 17. Inward threading of the inlet-adjustment sleeve 14 increases spring pressure against the inlet valve 12 to increase suction pressure required for volume expansion of whichever pneumatic resister 1 is employed for increasing pull resistance. The converse is employed for decreasing pull resistance. A sufficiently rigid inlet-valve spring 16 to function as a rigid sleeve converts inflow resistance from spring-operational mode to volume-operational mode because the inlet valve 12 then would be held rigidly at an adjusted distance from the inlet-valve seat 13. Spring-operational mode with a designedly lighter inlet-valve spring 16 is preferable because it is near totally pressure sensitive instead of near totally speed sensitive in comparison to volume-operational mode. The inlet-valve seat 13 surrounds an inlet-valve orifice 18 through which inflow air is directed to inlet orifice 19 in an end plate 10.

An outflow resister 3 can be a type that has an outlet valve 20 which seats against an outlet-valve seat 21 surrounding an outlet orifice 22 in the end plate 10. A threaded outlet-adjustment sleeve 23 has an outlet-valve orifice 24 surrounded by an outlet-spring step 25 against which an outlet spring 26 is anchored to apply opening pressure against the outlet valve 20 in accordance with threaded positioning of the outlet-adjustment sleeve 23. An adjustment knob 15 can be the same for both the inflow resister 2 and the outflow resister 3. Also like the inflow resister 2, volume-operational mode is achievable with a sufficiently rigid outlet spring 26 for the same reasons in reverse flow.

Referring to FIGS. 6–7, rotational indicia 27 and a pointer 28 on adjustment knobs 15 can be provided for fine-tune adjustment. Extra-fine threading of the inlet-adjustment sleeve 14 and the outlet-adjustment sleeve 23 is recommended for two reasons. First, it provides a lower cam angle for high positioning reliability. Second, it provides finer adjustment which is important because minute differences in valve openings make a big difference in airflow that affects pneumatic resistance. From the top, a uniformity of appearance of valves that are easy to set enhances product acceptance and marketing.

Referring to FIGS. 8–9, handles 8 and 9 can be attached to end plates 10 and to plunger shafts 11 with an attachment means, such as a quick-disconnect attachment 29, threaded attachments or other means. Other types of quick disconnect devices than the one depicted also can be employed. For example, a Luer connector that is used in the medical profession for syringes is good because it is particularly rigid. A plausible modification of a Luer connector would be a tapering of a connector shaft 30 and a matched tapering of a cylindrical receptor 31 that are shown straight as employed generally in mechanical fields. The tapering would be at distal ends of the connector shafts 30 and at proximal ends of the cylindrical receptors 31 beyond a lock pin 32 and a lock slot 33.

An attachment means such as a form of quick-disconnect attachment 29 allows use of body-connection components and body anchors such as body anchor 34 and multiple handles 8 and 9 on either end. Other body-connection components also can be attached to either or both ends of a pneumatic resister 1 with an attachment means that is standard for different handle and body-connection components. Foot straps 35 can be modified to be leg straps or shoulder attachments as optional types of body-connection components. Shoulder attachments, for instance, would permit shoulder and chest exercise independently of arm exercise when desired for chest buildup. Standardized attachment means opens this invention up to an equivalent of weight-lifting and pressing exercise simultaneously with adjustable resistance in opposite directions. This is a feat never before accomplished with such a convenient and highly versatile exerciser.

Figure 10:
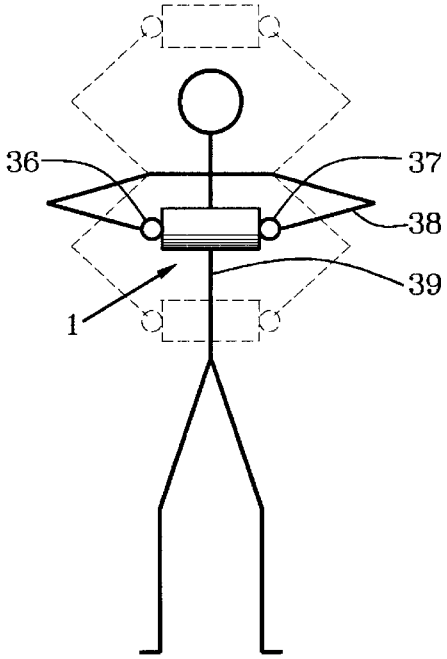
FIG. 10 is an elevation view of a stick representation of an exerciser using this invention for separate chest exercises.

Reference is made now to FIGS. 10–14 which depict stick figures of exercisers in relation to methods for using a pneumatic resister 1 having a first attachment 36 and a second attachment 37 that are either handles 8 and 9 or body anchors 34 as appropriate for particular methods of use. In FIG. 10, a method for exercising chest and arm muscles is outlined by arms 38 of an exerciser 39 grasping first attachments 36 and second attachments 37, which in this method would be handles 8 and 9, and then pushing and pulling the attachments 36 and 37 at arm heights which cause exercise of different parts of the exerciser's chest area. Different positions are shown in dashed lines.

Figure 11:
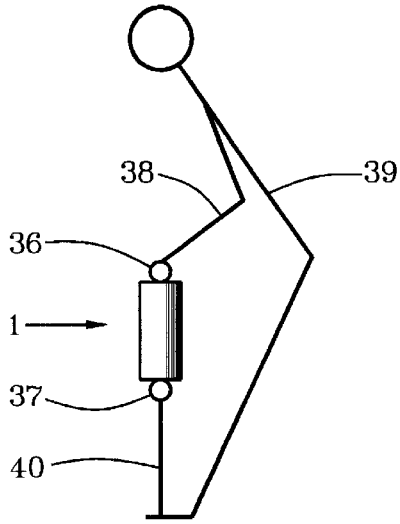
FIG. 11 is an elevation view of a stick representation of an exerciser using this invention for lifting and pressing exercises in a standing position.

In FIG. 11, a foot anchor 40 is attached to a second attachment 37 while a first attachment 36, preferably two handles 8 and 9 attached to a body anchor 34 as depicted in FIG. 8, is grasped for lifting and pressing exercise in a standing or variously upright position of the exerciser 39.

Figure 12:
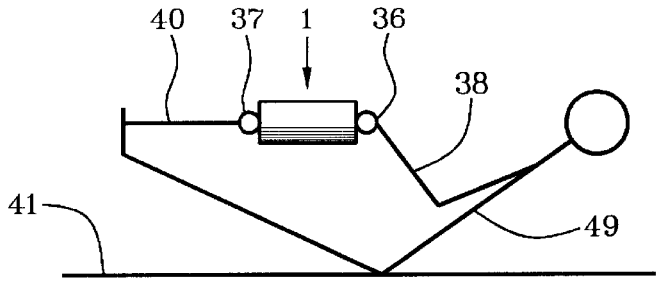
FIG. 12 is an elevation view of a stick representation of an exerciser using this invention for lifting and pressing exercises in a prone position.

In FIG. 12, similar methodical relationships are depicted as for FIG. 11, but with the exerciser 39 on a platform 41 such as an exercise pad or a bed to achieve different exercise effects for different types of people with different exercise objectives.

Figure 13:
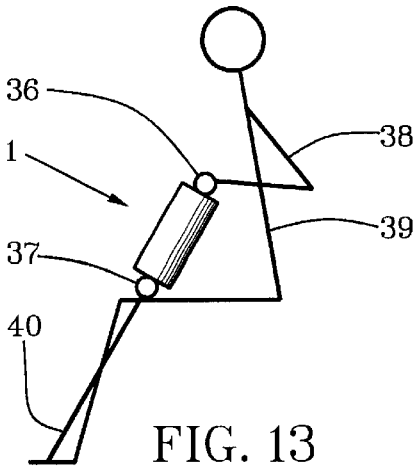
FIG. 13 is an elevation view of a stick representation of an exerciser using this invention for lifting and pressing exercises between feet and shoulders in a sitting position.

In FIG. 13, the exerciser 39 is sitting for selectively different exercising with components similar to those explained in relation to FIGS. 11–12.

Figure 14:
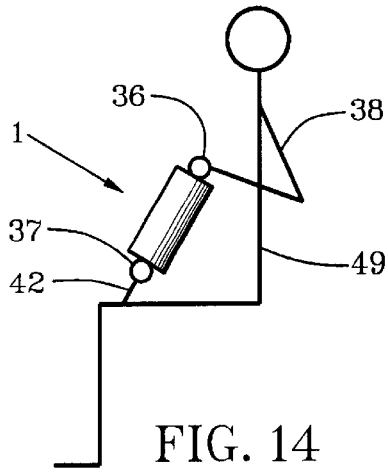
FIG. 14 is an elevation view of a stick representation of an exerciser using this invention for lifting and pressing exercises between knees and shoulders in a sitting position.

In FIG. 14, the exerciser 39 is sitting with a leg anchor 42 attached to the second attachment 37. Although shown with arms 38 in contact with the first attachment 36, the method shown here is particularly appropriate for a body anchor 34 shown in FIG. 8 for connection to shoulders of an exerciser 39 for chest exercise that is independent of arm and leg work.

Figure 15:
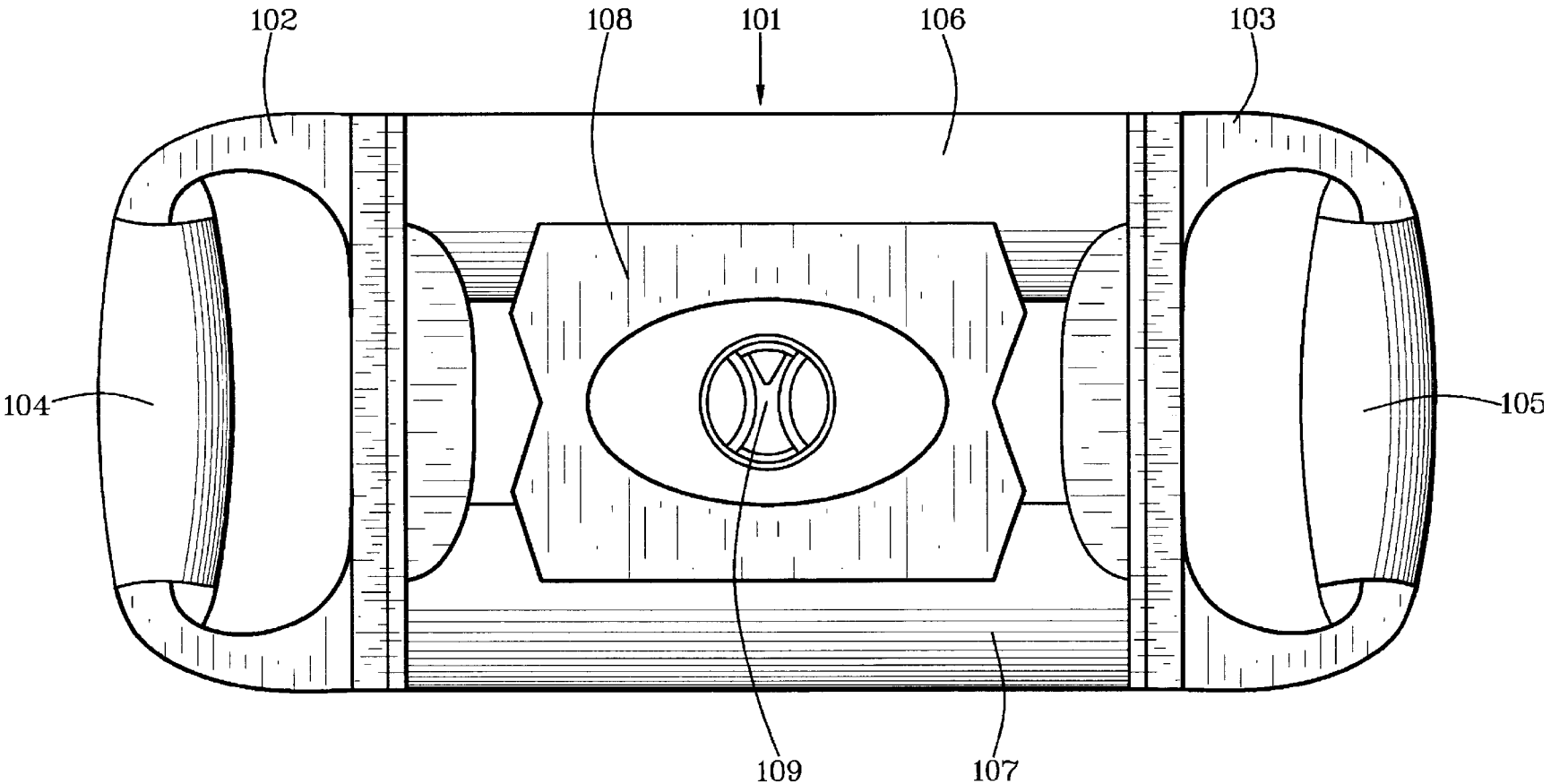
FIG. 15 is a side view of a dual cylinder pneumatic resister exercise device in the fully closed position.

In FIG. 15 a side view of the exterior of a single-action, double-plunger embodiment is shown having a fixed handle 102 with hand grip 104 on one end and a moveable handle 103 with hand grip 105 on the other end. The body of the device 101 has an upper cylinder 106 and a lower cylinder 107 connected by central section 108. A resister adjustment valve 109 in the central section 108 may be turned to adjust air flow through the valve, which in turn increases or reduces the pneumatic resistance when the moveable handle 103 is pulled outward from the body of the device 101. In other words, the more air that is vented out the valve 109 the less resistance there will be against the push or pull of a user's muscles. The valve 109 may be a standard petcock valve and have multiple positions such as high, medium or low depending on the resistance desired.

Figure 16:
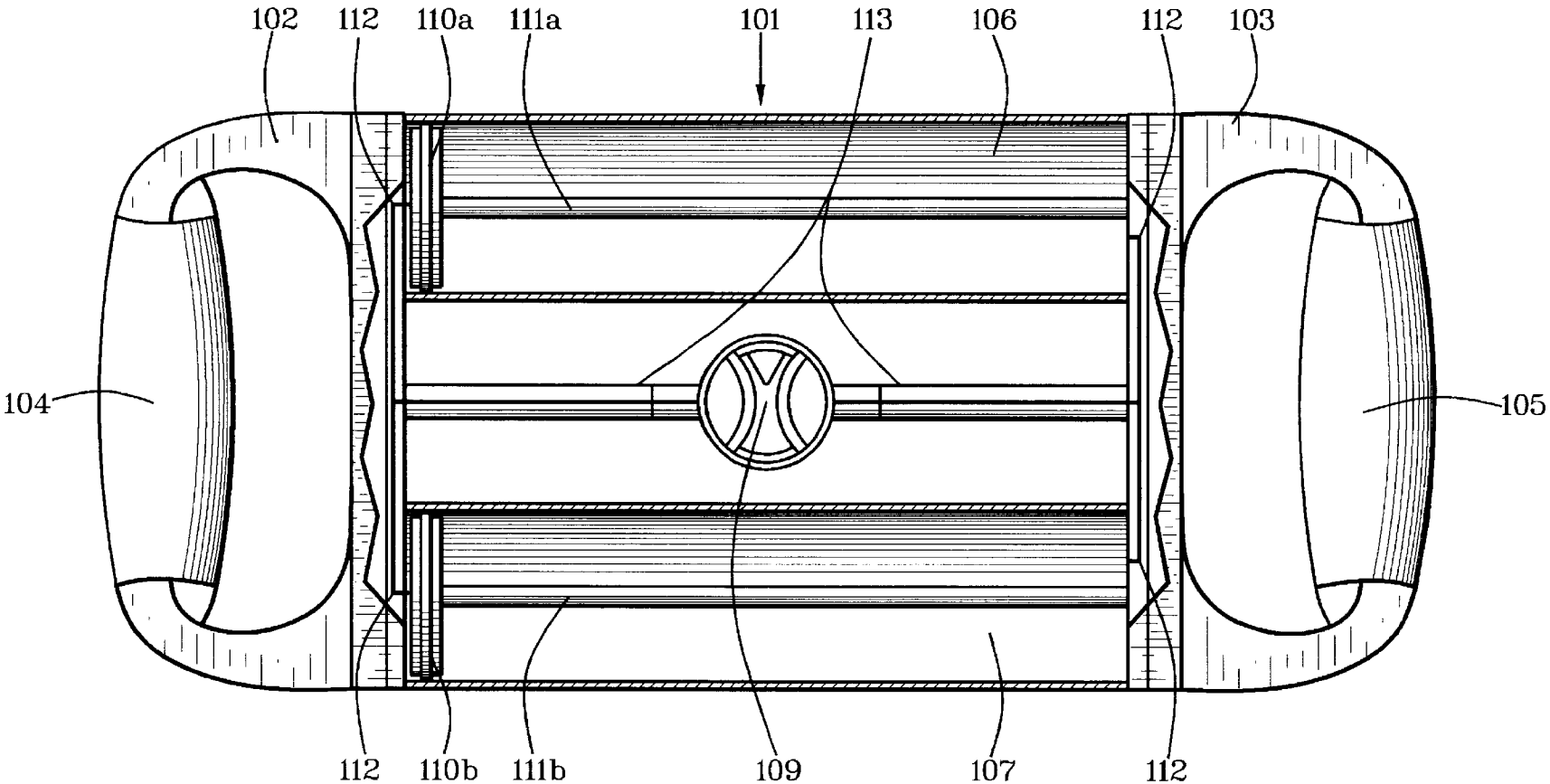
FIG. 16 is a side cut-away view showing a single action double plunger embodiment of the pneumatic resister exercise device.

In FIG. 16 the internal workings of the single-action, double-plunger embodiment shown in FIG. 15 are shown. The upper cylinder 106 and lower cylinder 107 contain rods 111*a* and 111*b* with plungers 110*a* and 110*b* mounted on the ends thereof. Air vents 112 on each end adjacent to each handle are the central connecting air vent 113 allow compressed air to pass to the vent 109 for resistance adjustment purposes. In operation when the moveable handle 103 is pulled away from the body 101 the air behind the plunger is adjustably compressed to provide inward resistance against the muscles. Conversely, when the removable handle 103 is pushed inward from an extended outward position the air in front of the plungers 110*a* and 110*b* is also compressed and forced through the vent 109 to provide adjustable resistance.

Figure 17:
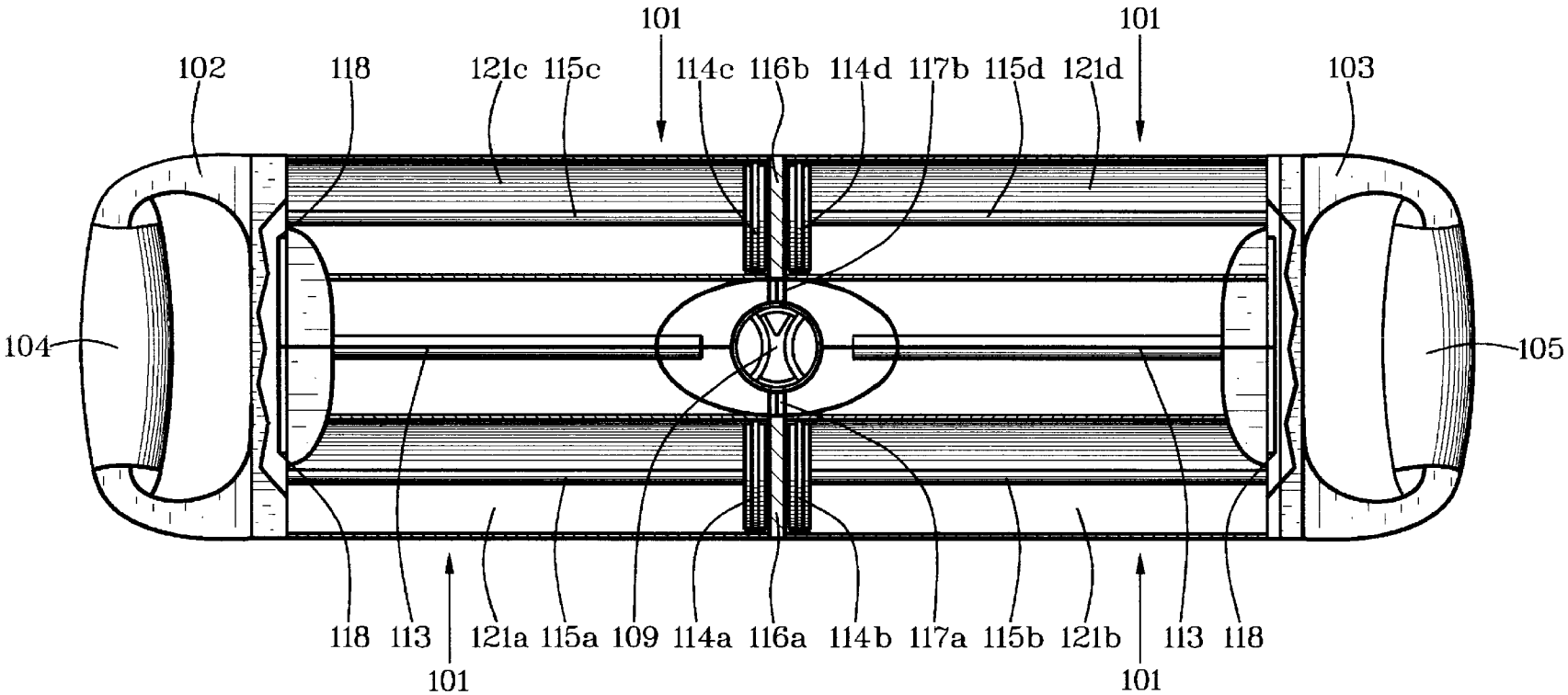
FIG. 17 is a side cut-away view of a double-action, double-plunger embodiment of the pneumatic resister exercise device.

In FIG. 17 a double-action version of the pneumatic resister exercise device of the present invention is illustrated wherein both handles 102 and 103 may be simultaneously pulled outward away from the body 101 or conversely pushed inward simultaneously by wrapping the fingers around the grips 104 and 105. As illustrated, this version has top and bottom cylinders of the body split into four pneumatic sections, 121*a* and 121*b* on the bottom and 121*c* and 121*d* on the top, supported by central walls 116*a* and 116*b*. Each cylinder has a plunger 114*a*, 114*b*, 114*c* and 114*d* mounted on rods 115*a*, 115*b*, 115*c* and 115*d*. Central air vents 117*a* and end air vents 118 connected to central vent 113 are provided to allow air to be vented through central valve 109 to adjustably control the resistance of the device. In operation when the handles 102 and 103 are pulled outward away from the body 101, air behind the plungers 114*a*, 114*b*, 114*c* and 114*d* is compressed with air being vented out of the valve 109 through vents 118 and 113 depending on the adjustable setting of the valve 109. Conversely, when the handles 102 and 103 are pushed inward from an outward extension the air in front of the plungers 114*a*, 114*b*, 114*c* and 114*d* is compressed against the central walls 116*a* and 116*b* and vented out the valve 109 through central plunger vents 117*a* and 117*b*. Thus, in the latter manner this pneumatic exercise devices provides resistance in both directions, inward and outward, to exercise different muscles of the body, particularly the chest.

Figure 18:
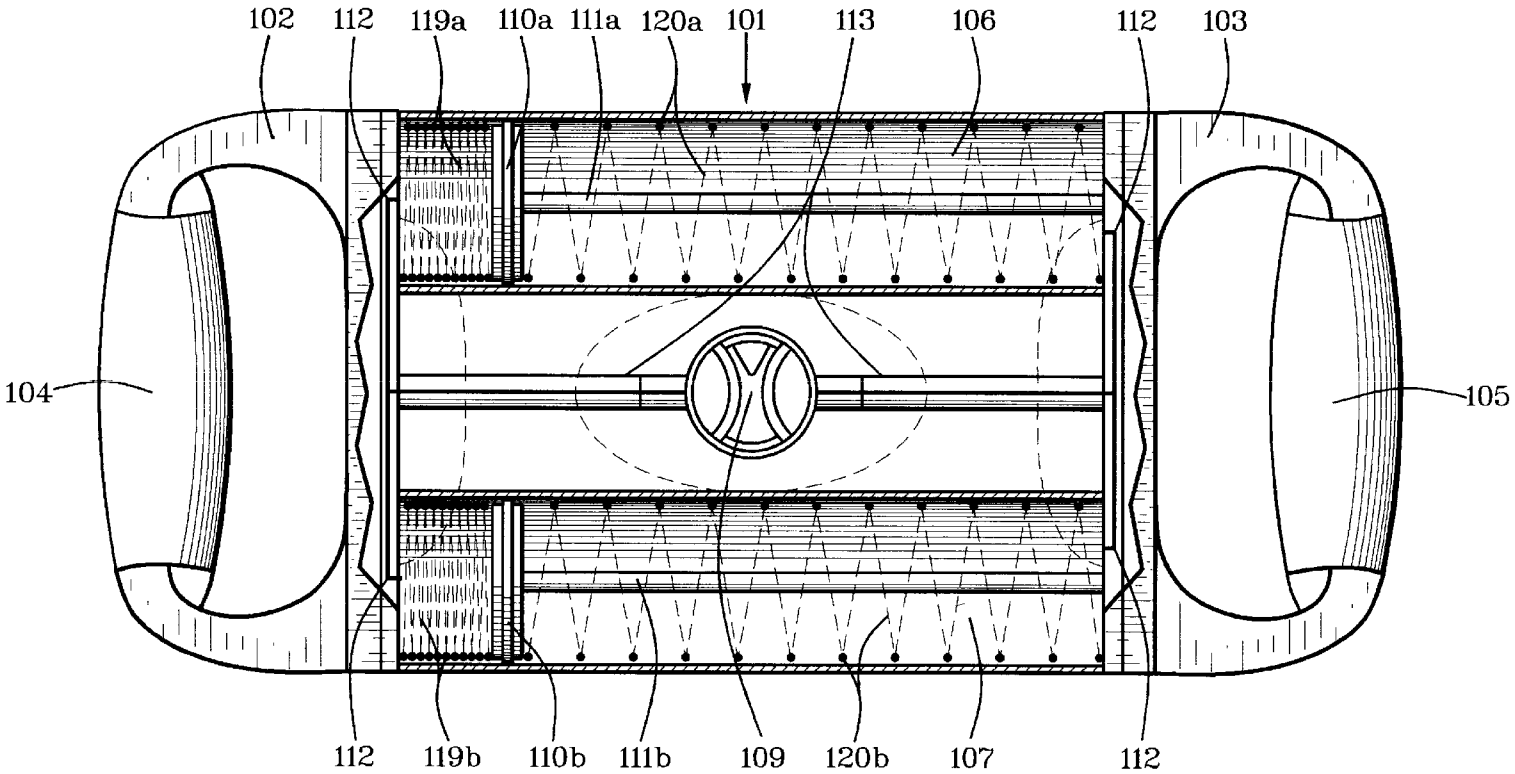
FIG. 18 is a side cut-away view of a spring assisted single-action, double-plunger embodiment of the pneumatic resister exercise device.

In FIG. 18 the single-action embodiment of the present invention previously illustrated in FIGS. 15 and 16 are shown being assisted by springs 119*a* and 119*b* and 120*a* and 120*b*. Springs 120*a* and 120*b* behind the plungers 110*a* and 110*b* add resistance force when the handle 103 is being pulled outward from the body 101 of the device. Conversely, this resistance may be somewhat offset by the outward force of the springs 119*a* and 119*b* in front of the plungers 110*a* and 110*b*. Conversely, when the handles 103 are pushed inward toward the body 101 from an outward extending position, resistance is provided by the springs 119*a* and 119*b* in front of the plungers 110*a* and 110*b*. Although FIG. 18 shows springs both in front of and behind the plungers, either or any combination may be used with or without the central valve 109, which also acts to increase or decrease resistance.

Although FIGS. 15, 16, 17 and 18 showing single or double action using two or four cylinders, a plurality of cylinders with plungers could be utilized to achieve the pneumatic resistance provided by this device. In any event, these double plunger versions provide more stability for the exerciser not provided by a single plunger version described and illustrated in FIGS. 1–4 as the inward or outer pressure against the handles does not result in the transverse movement which could cause the pneumatic exercise device to fall from one's hands during use.

A new and useful chest exerciser having been described, all such modifications, adaptations, substitutions of equivalents, combinations of parts, pluralities of parts, applications and forms thereof as described by the following claims are included in this invention.

We claim:

1. An exercise apparatus comprising:

a pneumatic resister of linear motion that is sized and shaped to be hand-held at opposite ends of the pneumatic resistor of linear motion by an individual for exercising;

holding means attachable to opposite ends of the pneumatic resister of linear motion; and flow-resistance means in flow-control relationship to pneumatic resistance of airflow by the pneumatic resister of linear motion, wherein the pneumatic resister of linear motion is a cylindrical pump having at least two pump plungers in sealed sliding contact with internal peripheries of at least two pump cylinders for each of said at least two pump plungers of the cylindrical pump.

2. An exercise apparatus as described in claim 1 wherein:

the flow-resistance means is at least one flow regulator in a central section between the cylinder, said means being permanently connected to each cylinder.

3. An exercise apparatus as described in claim 1 wherein:

the holding means is two handles with one of each of the two handles being attached to one of each of the opposite ends of the pneumatic resister of linear motion; and the two handles are sized and shaped to be held by an individual for exercising.

4. An exercise apparatus as described in claim 1 wherein:

the holding means is two attachment means with one of each of the two attachment means being attached to one of each of the opposite ends of the pneumatic resister of linear motion; and the two attachment means are sized, shaped and structured for attachment of handles and anchor means to the two attachment means as selected by an individual for exercising.

5. An exercise apparatus as described in claim 1 wherein:

the holding means is an attachment means on a first end and an anchor means on a second end of the pneumatic resister of linear motion; and the attachment means is sized, shaped and structured for attachment of handles and body-attachment means selectively to the first end of the pneumatic resister of linear motion.

6. A method for using exercise apparatus having:

a pneumatic resister of linear motion that is sized and shaped to be hand-held at opposite ends of the pneumatic resistor of linear motion by an individual for exercising;

holding means attachable to opposite ends of the pneumatic resister of linear motion; and flow-resistance means in flow-control relationship to pneumatic resistance of airflow by the pneumatic resister of linear motion, wherein the pneumatic resister of linear motion is a cylindrical pump having at least two pump plungers in sealed sliding contact with internal peripheries of at least two pump cylinders for each of said at least two pump plungers of the cylindrical pump;

The method comprising the following steps;

positioning hand-held handles on the opposite ends of the pneumatic resister of linear motion;

adjusting the flow-resistance means to require desired exercise work for opposite-directionally reciprocative actuation of the hand-held handles;

grasping the hand-held handles with opposite hands of any individual exerciser; and opposite-directionally reciprocating the hand-held handles intermediate positions relative to opposite sides of the exerciser in accordance with a desired routine for exercising specific muscles in chest and arms of the exerciser.

7. A method for using exercise apparatus having:

a pneumatic resister of linear motion that is sized and shaped to be hand-held at opposite ends of the pneumatic resistor of linear motion by an individual for exercising;

holding means attachable to opposite ends of the pneumatic resister of linear motion; and flow-resistance means in flow-control relationship to pneumatic resistance of airflow by the pneumatic resister of linear motion; and at least one inflow resister in at least one design wall which is adjustable separately from at least one outflow resister in at least one design wall of the pneumatic resister of linear motion wherein the pneumatic resister of linear motion is a cylindrical pump having at least two pump plungers in sealed sliding contact with internal peripheries of at least two pump cylinders for each of said at least two pump plungers of the cylindrical pump;

The method comprising the following steps:

attaching a first body anchor to a first end and a second body anchor to a second end of the pneumatic resister of linear motion;

adjusting inflow resistance and outflow resistance to require greater exercise work in a desired direction of reciprocation than in an opposite direction of reciprocation;

anchoring the first body anchor to a first portion of a body of an exerciser;

anchoring the second body anchor to a second portion of the body of the exerciser; and opposite-directionally reciprocating the first body anchor and the second body anchor intermediate the first portion of the second portion of the exercise in accordance with a desire routine for exercising specific muscles of the exerciser.

8. A method as described in claim 7 wherein:

the first body anchor is a lower-body anchor that is anchored to a low portion of the body of the exerciser and the second body anchor is an upper-body anchor that is anchored to a top portion of the body of the exerciser.

9. A method as described in claim 7 wherein:

the first body anchor is a lower-body anchor that is anchored to a low portion of the body of the exerciser and the second body anchor is at least one handle that is grasped by at least one hand of the exerciser.

10. The exercise apparatus of claim 1 further comprising:

one or more coil springs mounted on one or more sides of the pump plungers of at least one of the pump plungers in the cylinder to provide additional resistance during exercise.

* * * * *